US009789387B2

(12) United States Patent
Shea

(10) Patent No.: US 9,789,387 B2
(45) Date of Patent: Oct. 17, 2017

(54) TARGET GAME AND METHOD OF PLAYING A TARGET GAME

(71) Applicant: Thomas M. Shea, Troy, MI (US)

(72) Inventor: Thomas M. Shea, Troy, MI (US)

(73) Assignee: T.M. SHEA PRODUCTS, INC., Troy, MI (US)

( * ) Notice: Subject to any disclaimer, the term of this patent is extended or adjusted under 35 U.S.C. 154(b) by 0 days.

(21) Appl. No.: 14/713,354

(22) Filed: May 15, 2015

(65) Prior Publication Data

US 2015/0246280 A1 Sep. 3, 2015

Related U.S. Application Data

(63) Continuation of application No. 13/441,029, filed on Apr. 6, 2012, now abandoned.

(60) Provisional application No. 61/532,631, filed on Sep. 9, 2011, provisional application No. 61/509,736, filed on Jul. 20, 2011, provisional application No. 61/473,453, filed on Apr. 8, 2011.

(51) Int. Cl.

| | |
|---|---|
| ***A63B 63/04*** | (2006.01) |
| ***A63F 9/02*** | (2006.01) |
| ***A63B 63/08*** | (2006.01) |
| ***A63B 67/02*** | (2006.01) |
| ***A63B 71/00*** | (2006.01) |
| *A63B 63/00* | (2006.01) |
| *A63B 67/06* | (2006.01) |
| *A63F 7/36* | (2006.01) |
| *A63B 71/06* | (2006.01) |

(52) U.S. Cl.

CPC ..... *A63F 9/0204* (2013.01); *A63B 63/08* (2013.01); *A63B 67/02* (2013.01); *A63B 67/066* (2013.01); *A63B 71/0036* (2013.01); *A63F 9/02* (2013.01); *A63B 63/00* (2013.01); *A63B 67/06* (2013.01); *A63B 2071/0694* (2013.01); *A63B 2209/00* (2013.01); *A63B 2209/10* (2013.01); *A63B 2210/50* (2013.01); *A63B 2225/605* (2013.01); *A63F 2007/3655* (2013.01); *A63F 2250/205* (2013.01)

(58) Field of Classification Search

CPC ..... A63B 67/06; A63B 63/00; A63B 63/08; A63B 2225/605; A63B 2225/62

USPC ..... 273/398–402, 350

See application file for complete search history.

(56) References Cited

U.S. PATENT DOCUMENTS

| | | | | | |
|---|---|---|---|---|---|
| 1,114,523 | A | * | 10/1914 | Revell | 273/294 |
| 1,442,054 | A | * | 1/1923 | Dixon | A63F 9/0204 273/397 |
| 3,490,769 | A | * | 1/1970 | Torbett | A63B 63/007 273/398 |
| 3,843,124 | A | * | 10/1974 | Davis | A63B 67/06 273/398 |
| 4,989,880 | A | * | 2/1991 | Gettemeier | A63B 67/06 273/336 |

(Continued)

*Primary Examiner* — Mark Graham

(74) *Attorney, Agent, or Firm* — Stephen T. Olson; Harness, Dickey & Pierce, P.L.C.

(57) ABSTRACT

A target game including at least one target and at least one projectile. The at least one target is constructed of a flexible and self-supporting material. The at least one target is able to be configured in a first orientation and a second orientation. In the first orientation, the at least one target is generally planar. In the second orientation, the at least one target is generally conical.

15 Claims, 12 Drawing Sheets

(56) References Cited

U.S. PATENT DOCUMENTS

| | | | | | |
|---|---|---|---|---|---|
| 5,052,693 | A * | 10/1991 | Hicks | A63B 67/06 | 273/336 |
| 5,067,730 | A * | 11/1991 | Wanalista | A63B 67/06 | 273/400 |
| 5,110,139 | A * | 5/1992 | Baumgartner | A63B 67/06 | 273/400 |
| 5,209,493 | A * | 5/1993 | Chernek | A63B 67/06 | 273/400 |
| 5,318,307 | A * | 6/1994 | Bouchard | A63B 67/06 | 273/271 |
| 6,173,957 | B1 * | 1/2001 | James, Sr. | A63B 63/08 | 273/350 |
| 6,923,448 | B2 * | 8/2005 | Fairbanks | A63B 67/06 | 273/400 |
| 7,066,824 | B2 * | 6/2006 | Wenzler | A63B 69/3623 | 273/400 |
| 7,648,421 | B2 * | 1/2010 | Yoon | A63B 63/00 | 273/400 |
| 7,951,021 | B2 * | 5/2011 | Lessack | A63B 63/007 | 273/400 |
| 2005/0051968 | A1 * | 3/2005 | Froesel | A63B 67/06 | 273/336 |
| 2006/0066054 | A1 * | 3/2006 | Menendez | A63B 67/06 | 273/348 |
| 2010/0320692 | A1 * | 12/2010 | Tookey | A63B 67/06 | 273/398 |

* cited by examiner

TARGET GAME AND METHOD OF PLAYING A TARGET GAME

CROSS-REFERENCE TO RELATED APPLICATIONS

This application claims priority to U.S. patent application Ser. No. 13/441,029 filed 6 Apr. 2012 which claims the benefit of U.S. Provisional Patent Application Nos. 61/532,631 filed 9 Sep. 2011; 61/509,736 filed 20 Jul. 2011 and 61/473,453 filed 8 Apr. 2011, which applications are herein expressly incorporated by reference.

FIELD

The present teachings generally relate to a target game and a method for playing a target game. More particularly, the present teachings relate to a target game and a method of playing a target game involving a plurality of targets constructed of a flexible, self-supporting material rolled into a generally cylindrical form.

SUMMARY

According to one particular aspect, the present teachings provide a target game including at least one target and at least one projectile. The at least one target is constructed of a flexible and self-supporting material. The at least one target is able to be configured in a first orientation and a second orientation. In the first orientation, the at least one target is generally planar. In the second orientation, the at least one target is generally conical.

According to another particular aspect, the present teachings provide a method of playing a target game. The method includes providing at least one target in a first orientation. The at least one target is generally planar in the first orientation. The method additionally includes configuring the at least one target to a second orientation. The at least one target is generally cylindrical in the second orientation and has a first diameter. The method further includes attempting to throw a projectile into the at least one target until the projectile is thrown into the target, and determining a player score based on the number of throws needed to get the projectile into the target.

In accordance with yet another particular embodiment, the present teachings provide a target game including first, second and third targets. The first, second and third targets are each constructed of a flexible and self-supporting material and are each configurable in a first orientation and a second orientation. In the first orientation, each target is generally planar. In the second orientation, each target is concentrically oriented relative to both of the other targets. The target game additionally includes a securing arrangement for securing the first, second and third targets relative to one another in the second orientation. The target game further includes at least one projectile to be received within one of the first, second and third targets.

BRIEF DESCRIPTION OF THE DRAWINGS

The present teachings will become more fully understood from the detailed description and the accompanying drawings, wherein.

DETAILED DESCRIPTION OF VARIOUS ASPECTS

Figure 1:
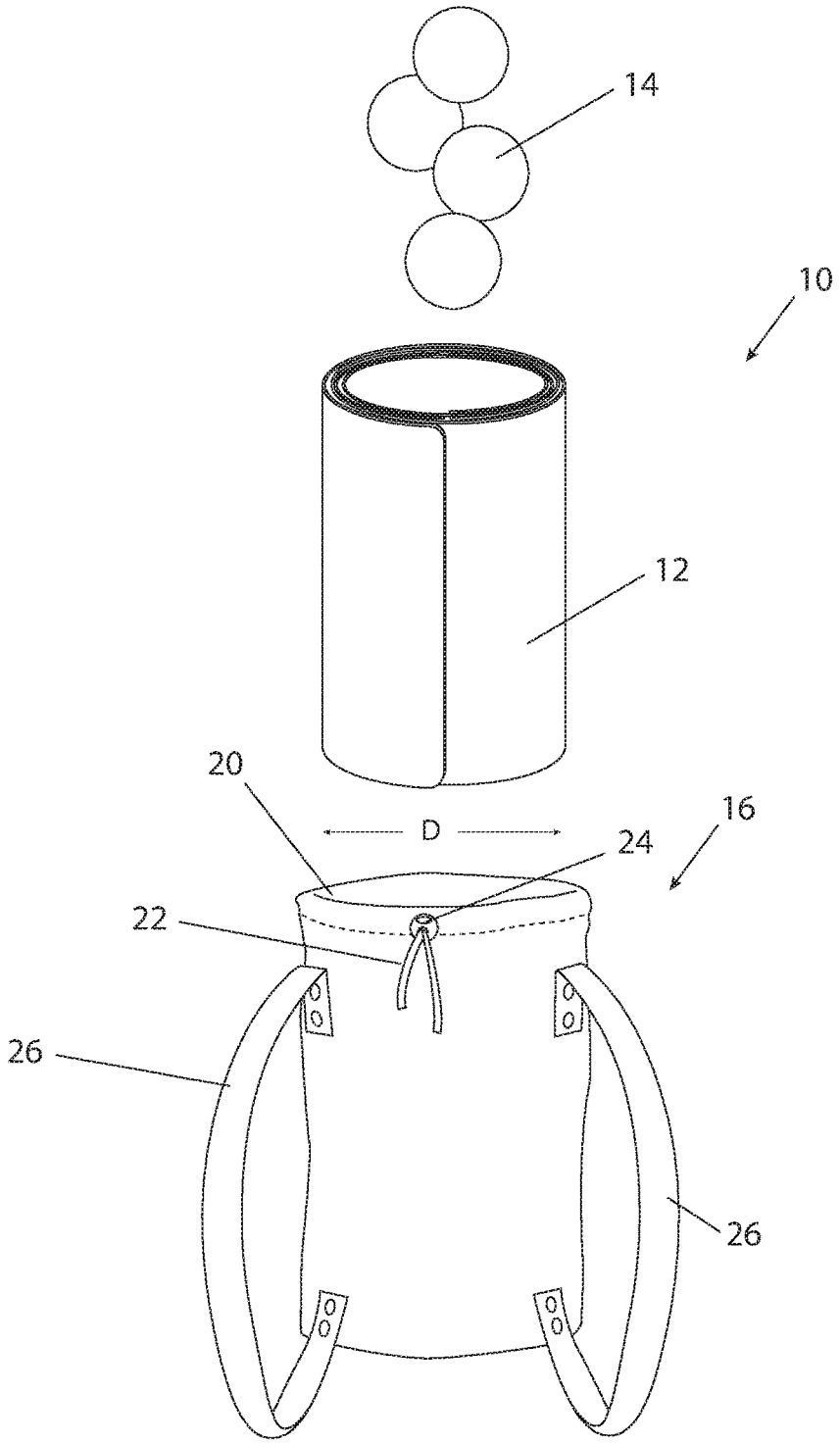
FIG. 1 is a perspective view of a target game according to the present teachings.

The following description is merely exemplary in nature and is in no way intended to limit the invention, its application, or uses.

With reference to FIGS. 1 through 4 of the drawings, a target game in accordance with the present teachings is illustrated and generally identified at reference character 10. As illustrated, the target game 10 may generally include one or more targets 12. The target game 10 may additionally include one or more projectiles 14. Further, the target game 10 may include a carry bag 16 for transporting the one or more targets 12 and the one or more projectiles 14.

The one or more targets 12 preferably includes a plurality of targets 12 that may be randomly arranged on a generally horizontal surface such as a lawn, a sand beach, water, or the like. Three targets 12 are shown randomly arranged in FIG. 2, for example. Insofar as the scope of the present teachings is concerned, the specific number of the targets 12 is immaterial. In this regard, the game 10 may include one target 12 or any number of multiple targets 12. In one particular application, the game 10 may include nine (9) targets 12.

Figure 2:
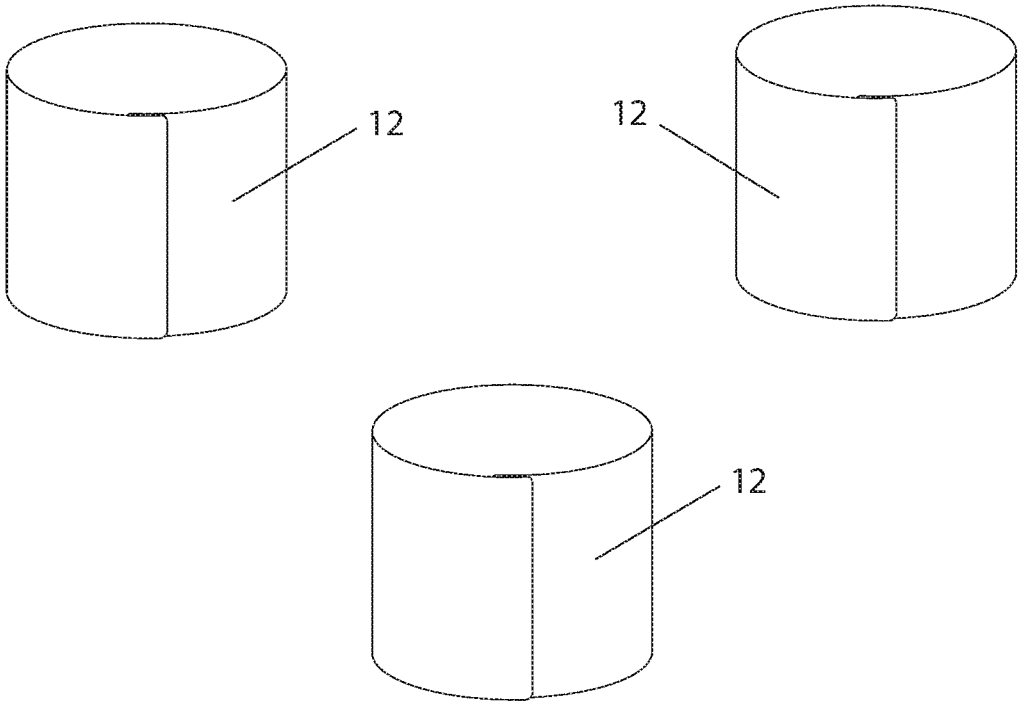
FIG. 2 is perspective view of a plurality of targets in accordance with the present teachings.
Figure 3:
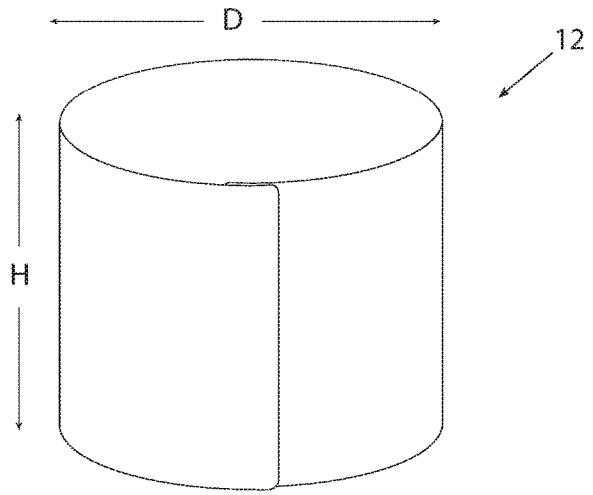
FIG. 3 is an enlarged view of one of the targets of FIG. 2, the target shown in a generally conical configuration.
Figure 4:
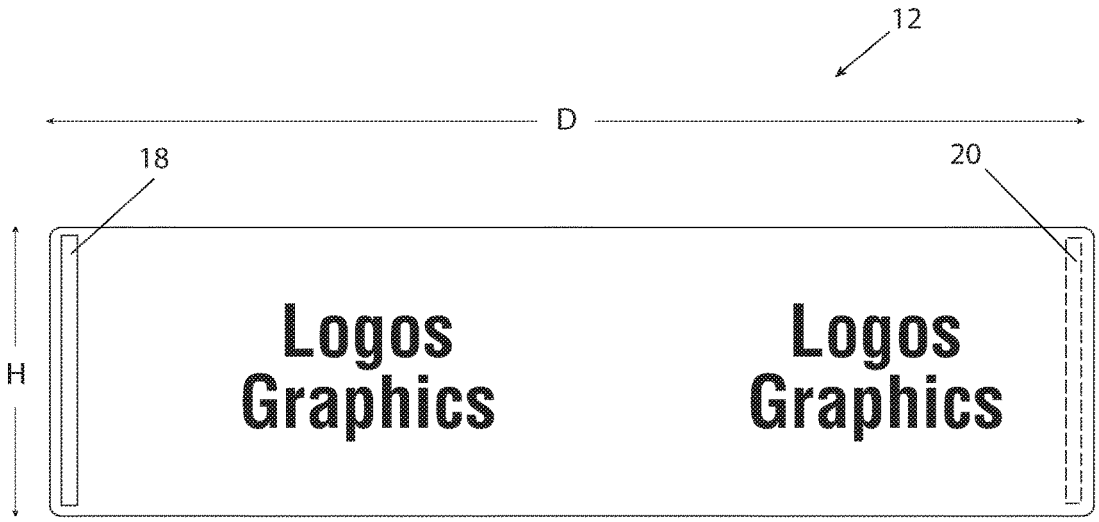
FIG. 4 is a plan view of a target in accordance with the present teachings, the target shown in a generally planar configuration.

As will become apparent below, the targets 12 may be configured in a first orientation or generally planar orientation. Additionally, the targets 12 may be configured in a second orientation or generally conical orientation. The first orientation is shown in FIG. 4, for example. The second orientation is shown in FIGS. 2 and 3, for example. Further, the targets 12 may also be configured in a reduced diameter configuration (shown in FIG. 1, for example) for storage and/or transportation.

As illustrated throughout the drawings, the targets 12 may be constructed of a flexible material that is self-supporting. As used herein, the term flexible means that the target can be rolled. In certain applications, the targets 12 may be constructed of a substrate suitable for printing. In this manner, the targets 12 may be printed with personal information (e.g., children's pictures), advertising, team logos, or the like. The present teachings may be readily adapted for fundraisers such as school fundraisers by printing with the school team and/or school colors. The targets 12 may be similarly printed for use at tailgate parties. In this regard, the targets 12 may be printed with graphics that show fan support for a particular college, professional, youth or other team.

In one particular application, the targets 12 may be constructed of Vinyl, pvc or any other suitable material. Such material may be self-supporting and is flexible enough to be rolled. Additionally, the material may be readily subject to a printing process. In other applications, the targets 12 may be constructed of a foam, including but not limited to an open celled foam. This type of material may be more buoyant, thereby facilitating use of the game 10 in a pool, lake or other body of water.

As illustrated, the individual targets 12 of the plurality of targets may be generally uniform in size and shape. Alternatively, however, the game 10 may include various targets of different sizes and shapes. It will be understood that both the size and shape of the targets 12 may be modified within the scope of the present teachings.

With specific reference to FIG. 4, on of the targets 12 is shown in the first orientation. In this orientation, the target 12 is generally planar. In a generally planar orientation, the target 12 may easily be subject to a printing process. It may also be desirable to store the targets 12 in such a first orientation.

With particular reference to FIG. 3, one of the targets 12 is shown in the second orientation. In the second orientation, the target 12 is generally conical. The free ends of the targets 12 may be fastened to maintain the conical shape.

The targets 12 may include a fastening arrangement for securing the target 12 in the second orientation. In one particular application, the fastening arrangement may include a hooked material 18 and a looped material 20. Such material is commercially available under the trademark Velcro®. As shown in FIG. 4, one end of the target 12 may include the hooked material 18. The other end of the target 12 may include the looped material 20.

The targets 12 have a height H, a length L and a full diameter D when fastened in the conical orientation with the fastening arrangement. The height H is significantly greater that the thickness. In one application, the height H may be approximately 13 inches and the length L may be about 47 inches. In this particular application, the full diameter D may be about 15 inches. The thickness may be about 0.25 inches. The particular dimensions herein identified are intended to describe exemplary embodiments and not intended to restrict the scope of the present teachings.

As described herein, the targets 12 are generally conical in shape. It will be understood, however, that the targets 12 may be square, rectangular or any other suitable shape and remain within the scope of the present teachings. Additionally, the targets 12 may be constructed in a such a manner that they are collapsible. Furthermore, the substrate used for the targets 12 may include a plurality of holes or areas of mesh that allow the passage of wind and increase outdoor stability of the targets 12.

The at least one projectile preferably includes a plurality of projectiles 14. The projectiles 14 may basically be any type of ball, bean filled bag or the like. The only requirement of the projectile 14 is that is has a diameter less than the full diameter D of the target 12 such that is can be thrown into the target 12. In the embodiment illustrated, all the projectiles 14 are generally the same. In alternative applications, however, various projectiles 14 may be provided within the scope of the present teachings. Different projectiles may be used for purposes of handicapping play of the target game 10, for example. In this regard, a small child may use a small projectile similar in shape to a golf ball and sufficiently weighted such that it may be easily thrown and an adult may use a projectile similar in size and weight to a beach ball that may be more difficult to throw and more difficult to fit within the target 12.

As shown in FIG. 1, the plurality of targets 12 may be stacked and collectively rolled. Upon collective rolling, the plurality of targets 12 may have a reduced diameter D'. The reduced diameter D' is smaller than the full diameter D and in certain applications may be approximately 7 inches.

The carry bag 16 may be sized to receive the plurality of rolled targets 12. In this regard, the carry bag 16 may have an upper opening 20 that is normally greater in size that reduced diameter D'. The size of the upper opening 20 can be reduced or completely closed by a drawstring 22 secured with a clip 24. The carry bag 16 may configured to include tote straps 26 for carrying over the shoulder or on the back. Alternatively, the carry bag 16 may have any other type of handle. At least a lower portion of the carry bag 16 may be constructed of a mesh material that allows sand and moisture to drain from the inside of the carry bag.

Various games may be played with the target game 10. In one particular application, a game may be played similar to golf. The targets 12 may be randomly placed. Targets 12 may be played at various distances and near various obstacles (trees, water hazards, and the like). The number of different challenges available is only limited by the players' imaginations. The players may alternatively or simultaneously throw their projectile 14 at a target 12. Score can be kept based on the number of throws it takes for a player to get his or her projectile in a particular target 12. Like golf, the lower score is better. Scores can be added for multiple targets 12.

Figure 5:
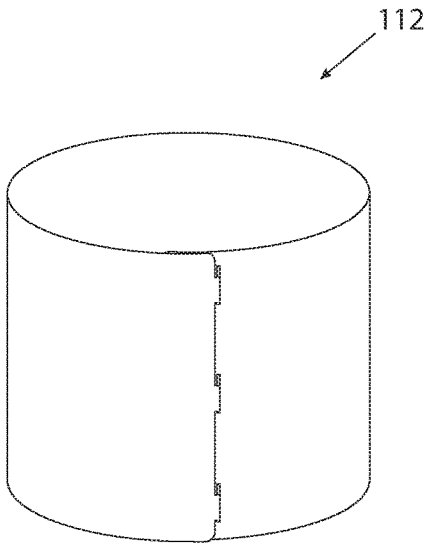
FIG. 5 is a perspective view similar to FIG. 3, illustrating a target in accordance with the present teachings incorporating an alternative arrangement for maintaining the target in the generally conical configuration.
Figure 6:
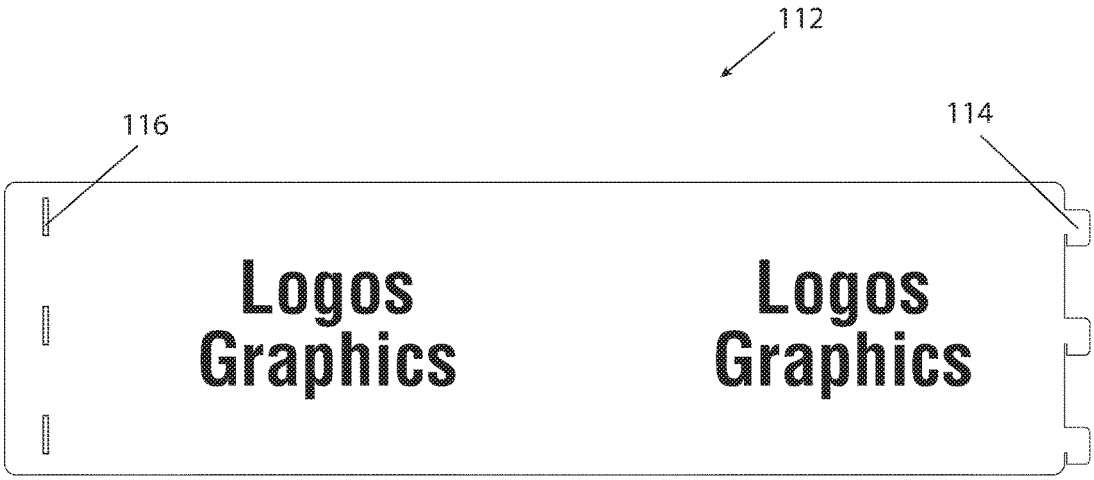
FIG. 6 is a plan view similar to FIG. 4, illustrating a target in accordance with the present teachings incorporating the alternative arrangement for maintaining the target in the generally conical configuration.

With reference to FIGS. 5 and 6, another target in accordance with the present teachings is illustrated and generally identified at reference character 112. The target 112 is identical to the target 12 described above except that an alternative fastening arrangement is incorporated. In this embodiment, one end of the target 112 carries one or more tabs 114 and the other end of the target 112 carries a corresponding number of slots 116 for receiving the tabs and thereby securing the target 12 in the generally conical orientation. While not illustrated, it will be understood that the targets 12 may be constructed to include an additional corresponding number of slots 116 spaced from the end of the target 112. In this manner, the tabs 114 may alternatively engage this second corresponding number of slots 116 to define a target 112 having a reduced diameter. It will be understood that any fastening arrangement may be incorporated within the scope of the present teachings.

In addition to the above, the targets 12 may be die to have various shapes. For example, the targets 12 may be cut in the shape of a fish. The targets 12 may alternatively be used to practice casting for fishing and for playing related games. In addition to fishing lures (without hooks), balls and bean filled bags, other types of projectiles may also be employed.

Still yet further to the above, in certain applications the targets 12 may be constructed of a rigid or substantially rigid material. In this regard, it is important that the targets 12 may be configured in a first orientation and a second orientation. The rigid or substantially rigid material may be folded rather than rolled. The geometry may be square, triangular or of any other suitable shape.

Figure 7:
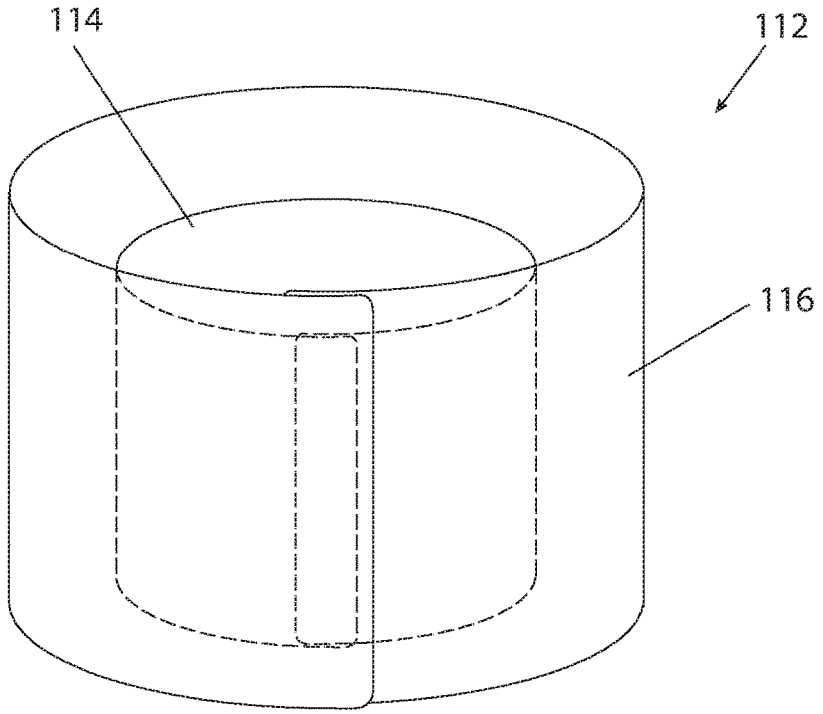
FIG. 7 a perspective view of another target arrangement in accordance with the present teachings, the target arrangement illustrated to include first and second concentric tubes.

With reference to FIG. 7, another target arrangement in accordance with the present teachings is illustrated and identified at reference character 112. In certain applications, it may be desirable to provide a target arrangement that includes two or more nested targets. The target arrangement 112 is illustrated to include first and second nested targets 114 and 116. Target 114 has a smaller diameter may be placed within target 116. Different point values may be assigned to throws landing within the two particular targets 114 and 116. As illustrated, the nested targets 114 and 116 may have different heights. In this regard, the inner target 114 may have a smaller height. Alternatively, the inner target 114 may have a greater height or a common height as compared to the outer target 16.

The nested targets 114 and 116 may be constructed of any suitable material, including but not limited to the materials identified herein with respect to the various other embodiments. Each of the nested targets 114 and 116 may be constructed of a planar material that can be configured into a cylinder and suitably secured. Alternatively, each of the nested targets 114 and 116 may be constructed of a material, such as foam, that may be flattened. In the embodiment illustrated, target 114 is simply placed within target 116. In other applications, it may be desirable to fix target 114 relative to target 116.

Figure 8:
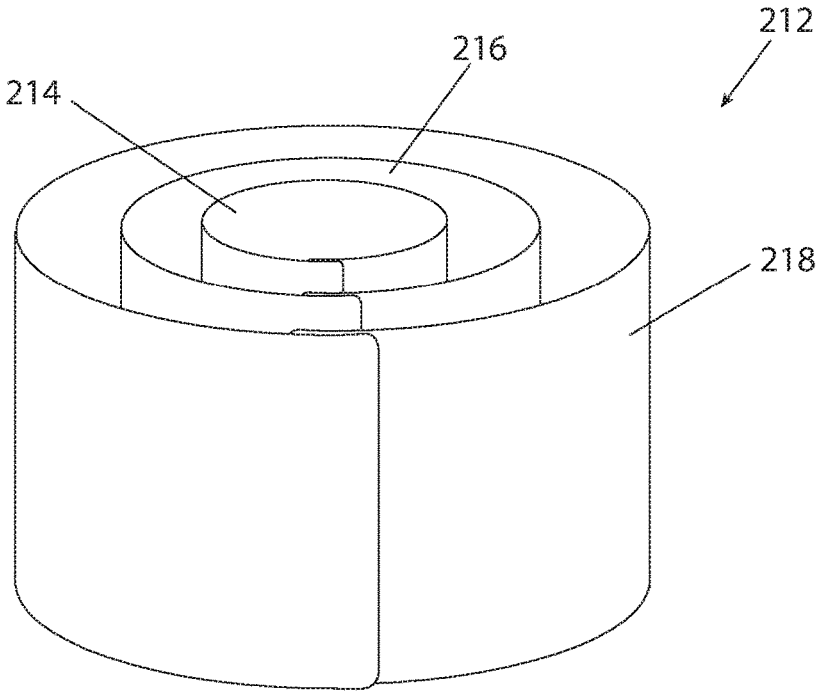
FIG. 8 a perspective view of another target arrangement in accordance with the present teachings, the target arrangement illustrated to include first, second and third concentric tubes.

Turning now to FIG. 8, another target arrangement in accordance with the present teachings is illustrated and identified at reference character 212. The target arrangement 112 is illustrated to include first, second and third nested targets 214, 216 and 218. Target 214 has the smallest diameter may be placed within target 216. Target 216 has a diameter smaller than target 218 and may be placed within target 218. As discussed above, different point values may be assigned to throws landing within the two particular targets 114 and 116. The nested targets 214, 216 and 218 may have common heights. Alternatively, the nested targets 214, 216 and 218 may have different heights. The nested targets 214, 216 and 218 may be constructed of any suitable material, including but not limited to the materials identified herein with respect to the various other embodiments. Each of the nested targets 214, 216 and 218 may be constructed of a planar material that can be configured into a cylinder and suitably secured. Alternatively, each of the nested targets 214, 216 and 218 may be constructed of a material, such as foam, that may be flattened.

Figure 9:
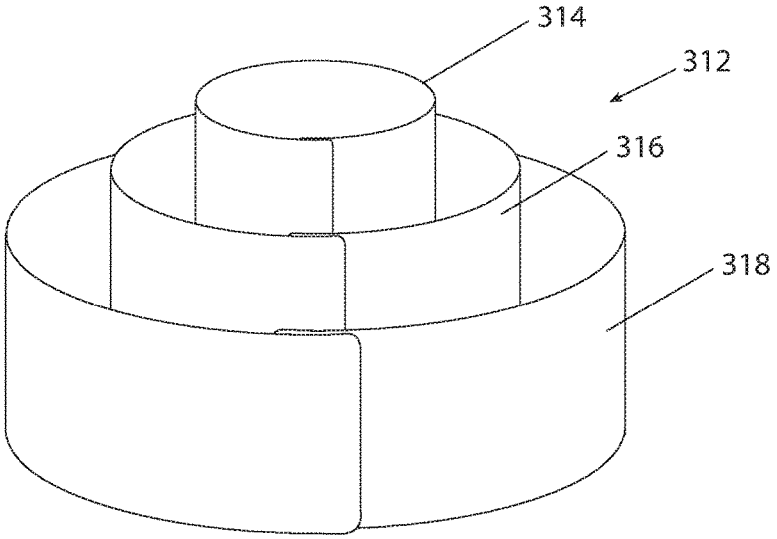
FIG. 9 is a perspective view of another target arrangement including first, second and third concentric tubes in accordance with the present teachings.
Figure 10:
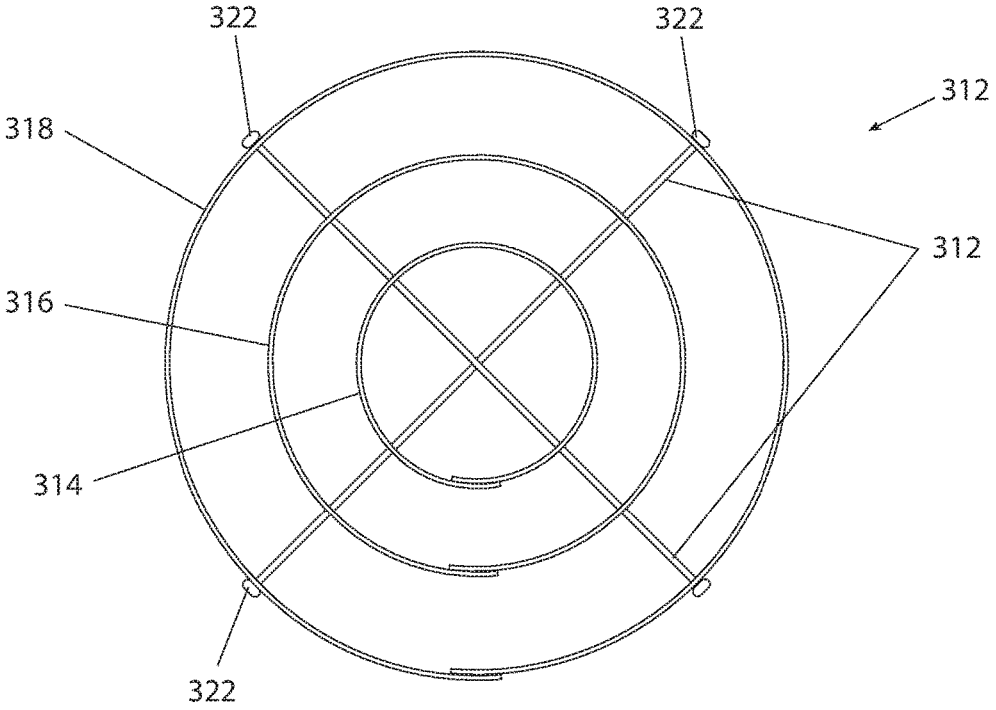
FIG. 10 is a top view of the target arrangement of FIG. 9.

With reference to FIGS. 9 and 10, another target arrangement in accordance with the present teachings is illustrated and identified at reference character 312. The target arrangement 312 may include a plurality of concentric tubes or nested targets. In the embodiment illustrated, the target arrangement 312 is illustrated to include first, second and third concentric tubes or nested targets 314, 316 and 318. It will be understood by those skilled in the art that the target arrangement 312 may include a greater or lesser number of nested targets within the scope of the present teachings.

The nested targets 314, 316 and 318 may be fixed relative to one another. As illustrated, the target arrangement 312 may additionally include one or more nylon cords 320 or other members for securing the nested targets 314, 316 and 318 relative to one another. The nylon cords 320 may both bisect each of the nested targets 314, 316 and 318 and be arranged relative to one another so as to form an "X". Each cord 320 may pass through holes in the nested targets 314, 316 and 318 and secured with enlarged heads 322 at opposite ends of the cords 320. The heads 322 may be larger than the holes in the nested targets 314, 316 and 318 and may be positioned on the outside of the outermost target 318.

The nested targets 314, 316 and 318 may have different heights. In this regard, the innermost target 314 may have the greatest height and the outermost target 318 may have the smallest height. Alternatively, the innermost target 314 may have smallest height and the outermost target 318 may have the greatest height. Still alternatively, each of the targets 314, 316 and 318 may have common heights.

The nested targets 314, 316 and 318 may be constructed of any suitable material, including but not limited to the materials identified herein with respect to the various other embodiments. Each of the nested targets 314, 316 and 318 may be constructed of a planar material that can be configured into a cylinder and suitably secured. Alternatively, each of the nested targets 314, 316 and 318 may be constructed of a material, such as foam, that may be flattened.

Figure 11:
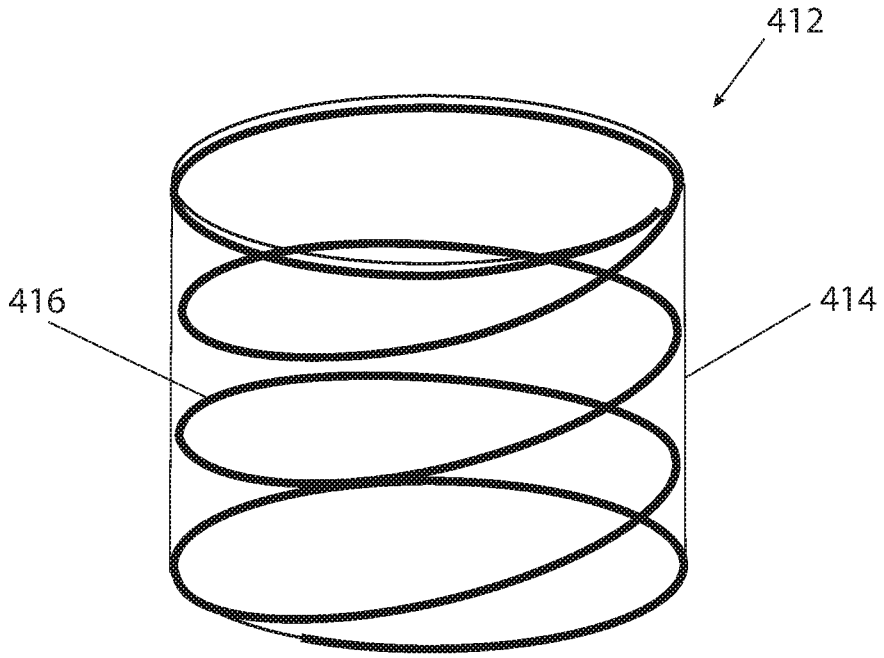
FIG. 11 is a perspective view of another target arrangement in accordance with the present teachings, the target shown to include a spring element to maintain the target arrangement in an expanded orientation.
Figure 12:
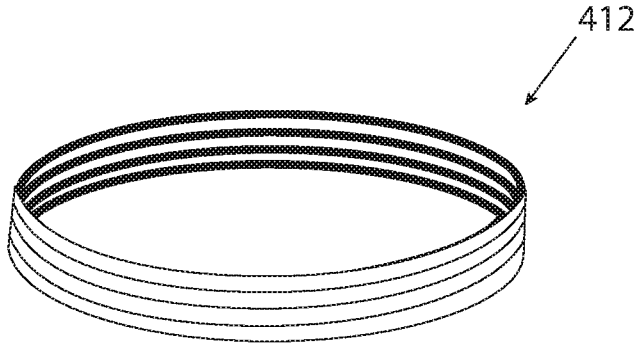
FIG. 12 is another perspective of the target arrangement of FIG. 11, the target arrangement shown in a collapsed orientation.

Turning now to FIGS. 11 and 12, another target arrangement in accordance with the present teachings is illustrated and identified at reference character 412. The target arrangement 412 is illustrated to generally include a sleeve 414 and a biasing member 416 for maintaining the sleeve in an expanded orientation. The expanded orientation is illustrated in FIG. 11. A collapsed orientation is illustrated in FIG. 12.

As illustrated, the biasing member is a coil spring 416. The sleeve 414 may surround the coil spring 416. The sleeve 414 may be constructed of a plastic material, a cloth material, or any other suitable material well known in the art.

Figure 13:
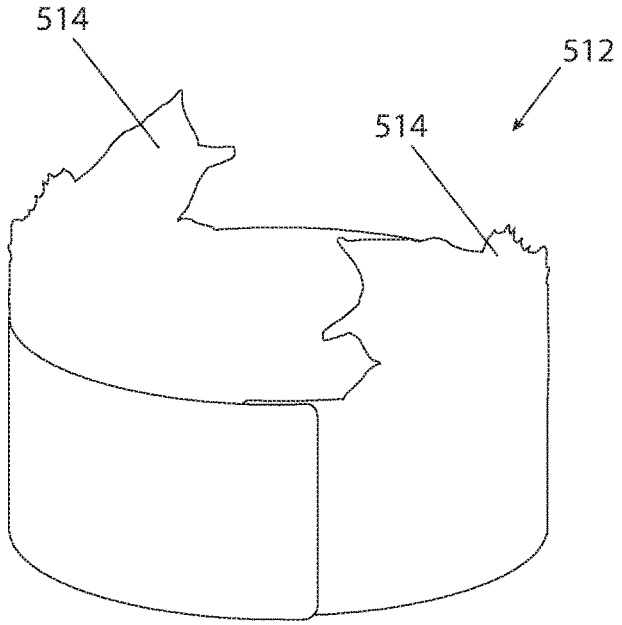
FIG. 13 is a perspective view of another target arrangement in accordance with the present teachings.
Figure 14:
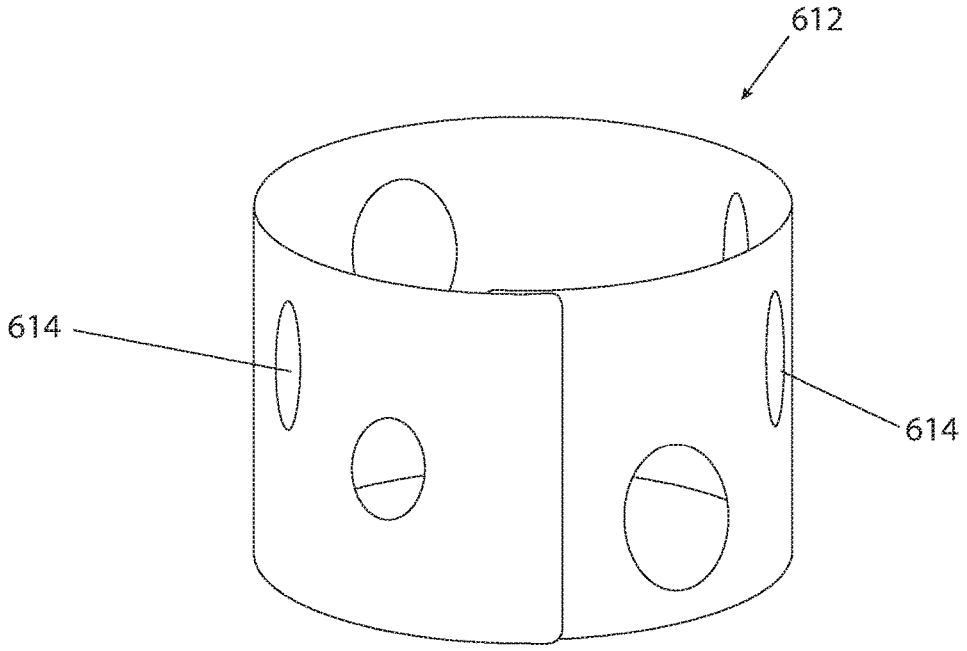
FIG. 14 is a perspective view of another target arrangement in accordance with the present teachings.

With reference now to FIGS. 13 and 14, two more target arrangements in accordance with the present teachings are illustrated. The target arrangements, which are identified at reference characters 512 and 612 may be die cut from a planar material. The die cuts may define decorative shapes. For example, the embodiment of FIG. 13 is die cut such that an upper edge represents two fish 514. Additionally, the die cuts may define decorative patterns. The embodiment of FIG. 14 provides a representative pattern that includes a plurality of circular openings 614.

Figure 15:
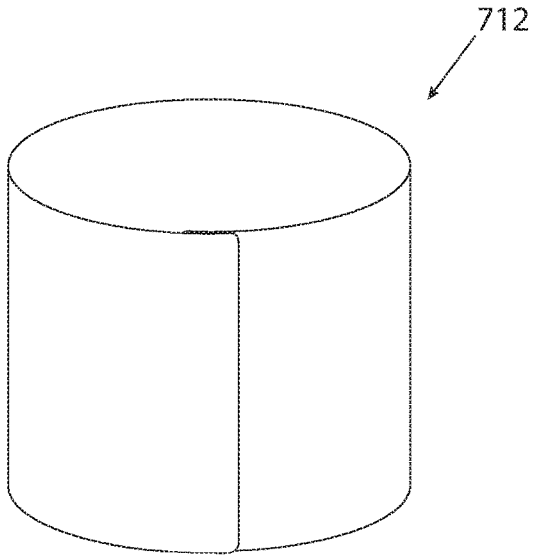
FIG. 15 is a perspective view of another target arrangement in accordance with the present teachings.
Figure 16:
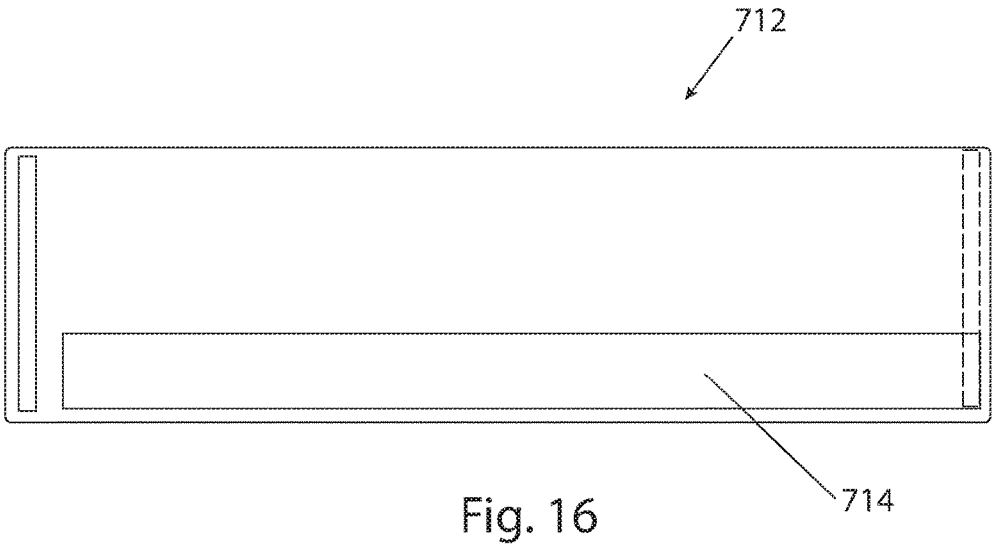
FIG. 16 is a plan view of the target of FIG. 15, the target arrangement shown in a generally planar configuration.

Turning to FIGS. 15 and 16, another target arrangement in accordance with the present teachings is illustrated and identified at reference character 712. As with the embodiments discussed above, the target arrangement 712 may be configured in both a first orientation and a second orientation. In the first orientation, the target arrangement 712 is generally planar. In the second orientation, the target arrangement is generally conical.

It will be understood that the embodiment of FIGS. 15 and 16 is similar to the embodiment of FIGS. 1-4 described above. For this reason, like reference characters may be used to identify similar features between the two embodiments. The target arrangement 712 differs in that it may incorporate a foam strip 714. The foam strip 714 may provide additional buoyancy for application in which the target arrangement 712 is used in the water. The foam strip 714 may be adhesively or otherwise suitable secured to target arrangement 712 and may substantially run the entire length of the target arrangement 712.

Figure 17:
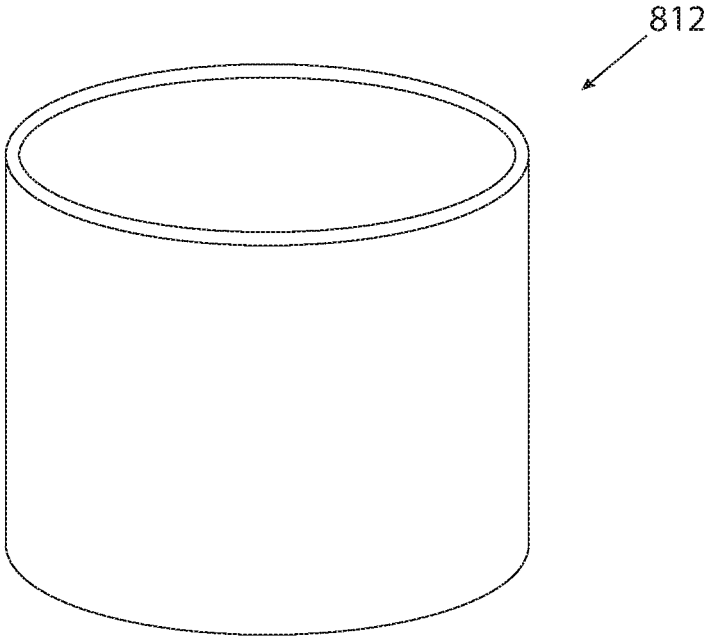
FIG. 17 is a perspective view of another target arrangement in accordance with the present teachings.

With reference now to FIG. 17, another target arrangement in accordance with the present teachings is illustrated and generally identified at reference character 812. In this embodiment, the target arrangement 812 is constructed of foam. For example, the target arrangement 812 may be constructed of a closed cell foam.

As with the embodiments discussed above, the target arrangement 812 may be configured in both a first orientation and a second orientation. In the first orientation, the target arrangement 812 is generally planar. In the second orientation, the target arrangement is generally conical. The target arrangement 812 may be flatted from the first orientation to the second orientation under a weight.

Figure 17A:
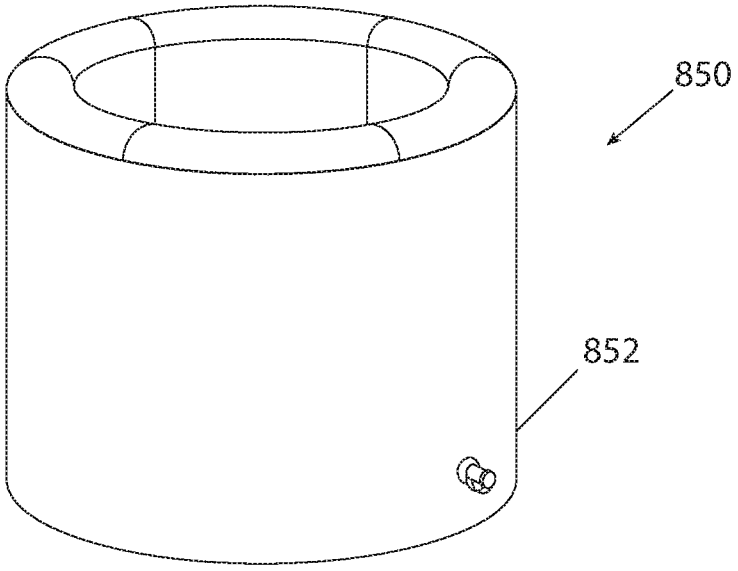
FIG. 17A is a perspective view of another target arrangement in accordance with the present teachings.

With reference now to FIG. 17A, another target arrangement in accordance with the present teachings is illustrated and generally identified at reference character 850. In this embodiment, the target arrangement 850 is inflatable. The target arrangement 850 may be constructed of a plastic material.

As with the embodiments discussed above, the target arrangement 850 may be configured in both a first orientation and a second orientation. In the first orientation, the target arrangement 850 may be generally planar (e.g., flattened). In the second orientation, the target arrangement is generally conical. The target arrangement 850 is illustrated to include a nipple for introducing a source of air in a conventional manner. For example, air can be blown into the target arrangement 850. In other applications, air may be pumped into the target arrangement 850.

Figure 18:
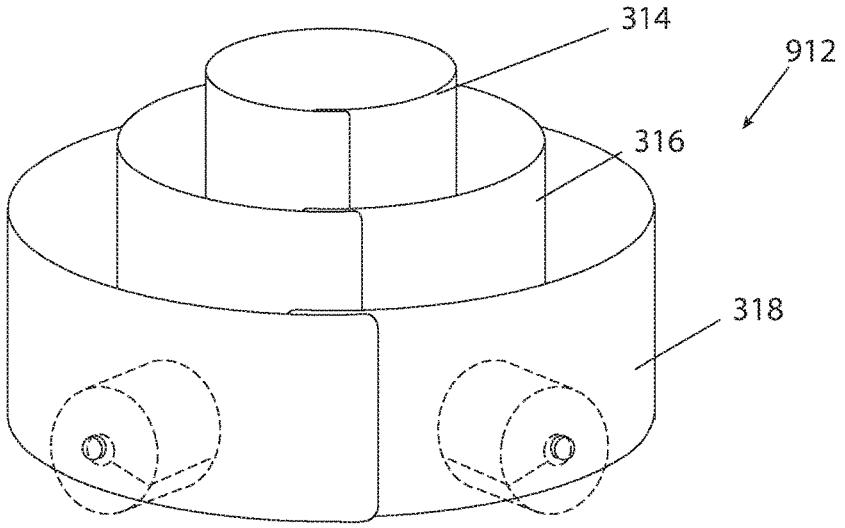
FIG. 18 is a perspective view of another target arrangement including first, second and third concentric tubes in accordance with the present teachings.
Figure 19:
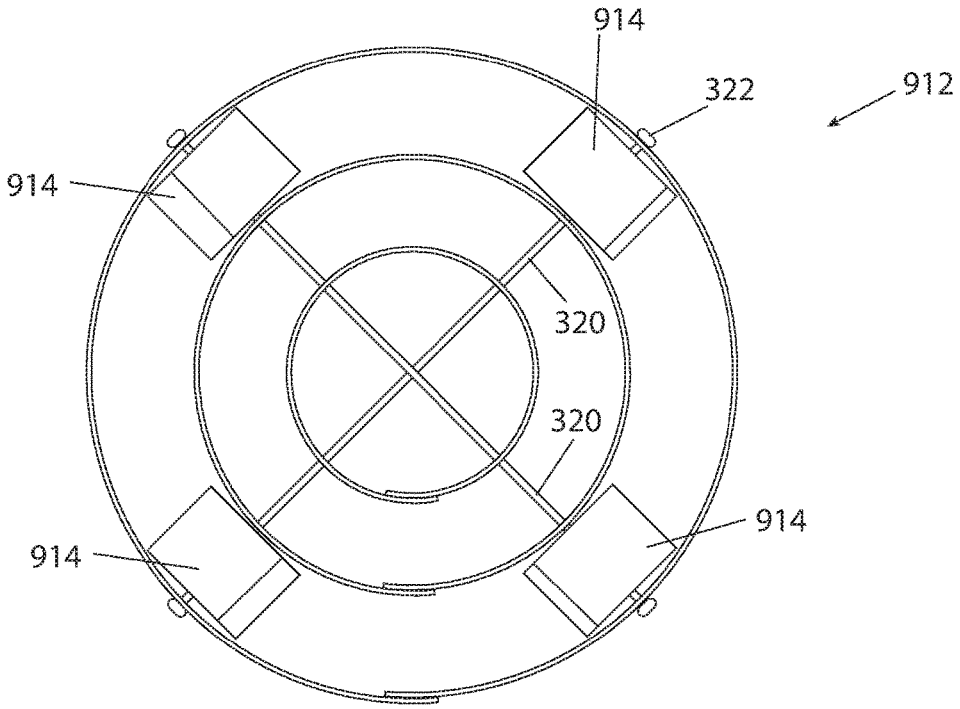
FIG. 19 is a top view of the target arrangement of FIG. 18.

Turning now to FIGS. 18 and 19, another embodiment of a target arrangement is illustrated and identified at reference character 912. The target arrangement 912 shares various features in common with previously described embodiments. For this reason similar features are identified with common reference characters.

The target arrangement 912 is most similar to the target arrangement 312. The target arrangement 912 additionally incorporates a plurality of buoyant members 914. The buoyant members 914 may aid the target arrangement in floating for use in the water. In the embodiment illustrated, the target arrangement 912 includes four buoyant members 914. It will be understood, however, that the target arrangement 912 may include a greater or lesser number of buoyant members 914 within the scope of the present teachings.

As discussed above, the buoyant members 914 may be generally cylindrical in shape. The buoyant members 914 may be constructed of foam or other suitable material and may define central openings for receiving one of the tubular members 952. As shown, the buoyant members 914 may be disposed between the outermost target 318 and the middle target 316. While the buoyant members may be alternatively located between the innermost target 314 and the middle target 316, the prior described location is generally preferred given the increased stability provided. The buoyant members may include apertures to accommodate the tubular members 952.

Figure 20:
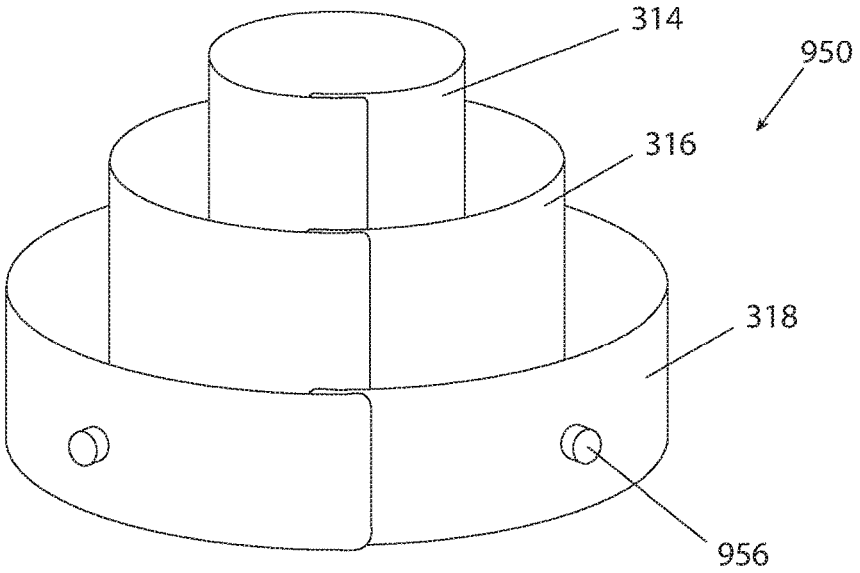
FIG. 20 is a perspective view of another target arrangement including first, second and third concentric tubes in accordance with the present teachings.
Figure 21:
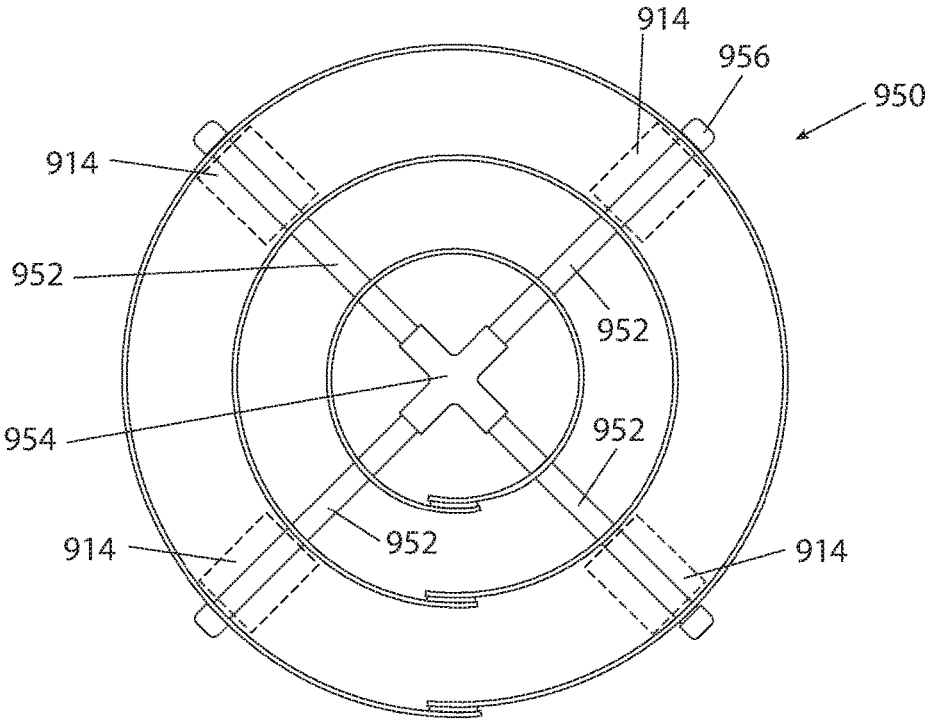
FIG. 21 is a top view of the target arrangement of FIG. 20.

With reference to FIGS. 20 and 21 another embodiment of a target arrangement is illustrated and identified at reference character 950. The target arrangement 950 shares various features in common with previously described embodiments. For this reason similar features are identified with common reference characters.

The target arrangement 950 is most similar to the target arrangement 912. The target arrangement 950 differs from the target arrangement 912 by incorporating a plurality of tubular members 952 in place of the nylon cords 320. As above, buoyant members 914 may aid the target arrangement 950 in floating for use in the water. In the embodiment illustrated, the target arrangement 950 includes four buoyant members 914. It will be understood, however, that the target arrangement 950 may include a greater or lesser number of buoyant members 914 within the scope of the present teachings.

In the embodiment illustrated, the tubular members may by PVC pipes 952. The tubular members 952 may be hollow and may have an outer diameter of approximately 0.50 inches. As illustrated, the tubular members 952 may be four in number and may be joined by a connecter 954. A greater or lesser number of tubular members may be incorporated within the scope of the present teachings.

The connector 954 may similarly be conducted of PVC. The connector 954 may define a plurality of female receptacles receiving ends of the tubular members 952. The ends of the tubular members 952 may be press-fit into the connector 954 or otherwise suitable attached.

The tubular members 952 may pass through openings in the targets 314, 316, 318. A free end of each tubular member 952 may exit the outermost target 318. The free ends may each receive a cap 956 for retention purposes. The caps 956 may be constructed of plastic, rubber or other suitable material. In the embodiment illustrated, the caps 956 are press-fit on the free ends of the tubular member 952. The caps 956 may be alternatively secured to the ends in any manner well known in the art.

It will now be clearly understood that the various embodiments of the present teachings provide target that may be configured in a first orientation or generally planar orientation. Additionally, the target 12 may be configured in a second orientation or generally conical orientation.

The foregoing discussion discloses and describes merely exemplary arrangements of the present invention. One skilled in the art will readily recognize from such discussion, and from the accompanying drawings and claims, that various changes, modifications and variations can be made therein without departing from the spirit and scope of the present invention.

What is claimed is:

1. A target game comprising:

a plurality of targets including an innermost target, a middle target and an outermost target, each target independently constructed of a flexible and self-supporting material, each target able to be independently configured in a first orientation and a second orientation, each target being generally planar in the first orientation and generally cylindrical in the second orientation, wherein the plurality of targets are concentrically oriented relative to one another about a common axis;

a plurality of tubular members joined by a connector, each tubular member radially extending from the connector and through holes in each of the plurality of targets proximate a lowermost end of the targets, the common axis passing through the connector; and at least one projectile to be received within the targets of the plurality of targets.

2. The target game of claim 1, wherein the plurality of targets may be stacked in the first orientation directly on top of one another and collectively rolled.

3. The target game of claim 1, wherein the targets of the plurality of targets are pre-printed with graphics.

4. The target game of claim 1, wherein the plurality of tubular members each extend perpendicular to the common axis.

5. The target game of claim 1, wherein the plurality of targets are constructed of foam.

6. The target game of claim 1, wherein each target defines a circumferentially closed cylinder that is permanently closed in a circumferential direction.

7. The target game of claim 1, wherein each target includes a buoyant foam strip.

8. The target game of claim 1, wherein each target is releasably secured in the generally cylindrical orientation with loop materials.

9. The target game of claim 1, wherein each target is releasably secured in the generally cylindrical orientation with at least one tab and at least one cooperating slot.

10. The target game of claim 1, wherein each target is inflatable.

11. The target game of claim 1, wherein the innermost, middle and outermost targets have first, second and third heights, respectively, the first height being greater than the second height, the second height being greater than the third height.

12. The target game of claim 1, wherein the first, second and third targets have first, second and third heights, respectively, the first height being greater than the second height, the second height being greater than the third height.

13. A target game comprising:

a plurality of targets including an innermost target, a middle target and an outermost target, each target independently constructed of a flexible and self-supporting material, each target able to be independently configured in a first orientation and a second orientation, each target being generally planar in the first orientation and generally cylindrical in the second orientation, the plurality of targets being concentrically oriented to one another about a common axis;

a connector, the common axis passing through the connector;

a plurality of securing members radially extending from the connector, each securing member oriented perpendicular to the common axis and passing through each of the targets of the plurality of targets; and at least one projectile to be received within the targets of the plurality of targets.

14. The target game of claim 13, wherein the plurality of securing members includes four tubular members.

15. The target game of claim 13, wherein the first, second and third targets have first, second and third heights, respectively, the first height being greater than the second height, the second height being greater than the third height.

* * * * *